US006311408B1

(12) United States Patent
Madayag

(10) Patent No.: US 6,311,408 B1
(45) Date of Patent: Nov. 6, 2001

(54) MULTI-SCALE POSITION LOCATOR AND METHOD FOR LOCATING A POSITION

(75) Inventor: Rudy Madayag, Kenmore, WA (US)

(73) Assignee: R M Products, Inc., Kenmore, WA (US)

( * ) Notice: Subject to any disclaimer, the term of this patent is extended or adjusted under 35 U.S.C. 154(b) by 0 days.

(21) Appl. No.: 09/310,535

(22) Filed: May 12, 1999

(51) Int. Cl.[7] ..... B43L 7/00; A41H 1/00

(52) U.S. Cl. ..... 33/653; 33/1 G; 33/494; 33/563

(58) Field of Search ..... 33/1 F, 1 G, 1 AA, 33/11, 17 R, 485, 486, 487, 494, 520, 563, 574, 575, 613, 645, 653

(56) References Cited

U.S. PATENT DOCUMENTS

| | | | | |
|---|---|---|---|---|
| D. 140,152 | | 1/1945 | Aichele . | |
| 346,371 | | 7/1886 | Humphrey . | |
| D. 396,424 | | 7/1998 | Bedol et al. | D10/71 |
| D. 397,303 | | 8/1998 | Bedol et al. | D10/71 |
| D. 398,865 | | 9/1998 | Dietterich et al. | D10/62 |
| 676,740 | | 6/1901 | Farini . | |
| 1,383,140 | * | 6/1921 | Naterman | 33/485 |
| 1,433,083 | | 10/1922 | Leishman . | |
| 1,745,188 | | 1/1930 | Pipirs . | |
| 2,387,986 | * | 10/1945 | Evans | 33/653 |
| 2,821,787 | * | 2/1958 | Shepard | 33/653 |
| 3,798,781 | * | 3/1974 | Wolfe | 33/11 |
| 4,302,884 | * | 12/1981 | Pallone | 33/653 |
| 4,490,921 | | 1/1985 | Woods et al. | 33/476 |
| 4,750,270 | * | 6/1988 | Kundikoff | 33/494 |
| 5,033,200 | | 7/1991 | Leung | 33/485 |
| 5,084,982 | | 2/1992 | Feng | 33/810 |
| 5,444,920 | * | 8/1995 | Nelson | 33/11 |
| 5,497,558 | | 3/1996 | Wagner | 33/27.03 |
| 5,501,019 | * | 3/1996 | Concari et al. | 33/494 |
| 5,557,996 | * | 9/1996 | Reber et al. | 33/563 |
| 5,813,127 | * | 9/1998 | Blevins | 33/494 |

FOREIGN PATENT DOCUMENTS

| | | | | |
|---|---|---|---|---|
| 2193929 | * | 2/1988 | (GB) | 33/494 |

OTHER PUBLICATIONS

"SOLDIERS" pamphlet, Jan., 1992.

* cited by examiner

*Primary Examiner*—G. Bradley Bennett
(74) *Attorney, Agent, or Firm*—Graybeal Jackson Haley LLP

(57) ABSTRACT

A device includes first and second scales. The first scale has a reference mark, at least one first mark disposed a first distance from the reference mark in a first direction, and at least one second mark disposed the first distance from the reference mark in a second direction that is opposite to the first direction. The second scale is perpendicular to the first scale and includes at least one third mark disposed a second distance from the first scale. One can use such a device to position items on a uniform or other back piece without the guesswork associated with conventional measuring devices. For example, he/she can use the first scale as a centering scale to locate a pocket midline, and then, without having to move the device, can use the second scale as a measuring scale to locate a point along the pocket midline. Therefore, such a multi-scale device allows one to place an item such as a badge above the pocket more quickly and in a less cumbersome manner than a conventional measuring device would typically allow.

23 Claims, 5 Drawing Sheets

MULTI-SCALE POSITION LOCATOR AND METHOD FOR LOCATING A POSITION

TECHNICAL FIELD

This invention pertains generally to measuring devices and more particularly to a multi-scale position locator and a method for locating a position such as a proper badge placement on a uniform.

BACKGROUND OF THE INVENTION

Referring to FIG. 1, many organizations require their uniform-wearing members to position items on their uniforms according to organizational guidelines. For example, the army requires a soldier 10 wearing a uniform 12 to center his nameplate 14 on a flap 16 of a right pocket 18 between pocket sides 20 and 22, the top of a pocket button 24, and a pocket top 26. The army also requires the soldier 10 to center his unit award 28 over the pocket 18 such that the bottom of the award is ⅛ inch above the pocket top 26. Because he often removes items like the nameplate 14 and the unit award 28 before laundering his uniform 12, the soldier 10 positions and reattaches such items on a regular basis.

Because these guidelines often require precise positioning of such items, one typically uses a conventional measurement device such as a ruler to accurately locate the specified item positions on the uniform.

FIGS. 2 and 3 describe a technique for placing the award 28 above the pocket 18 of the uniform 12 (all of FIG. 1) using a conventional ruler 30. For clarity, the pocket flap 16 and the button 24 are omitted from FIGS. 2 and 3.

Referring to FIG. 2, to locate the specified position of the unit award 28 (FIG. 1) using the ruler 30, one first determines the horizontal midline 32 of the pocket 18 by aligning ruler marks with the pocket sides 20 and 22, calculating the distance between the sides 20 and 22, halving this distance, and marking the halfway point. In the illustrated example, one aligns the 4-inch and 7-inch marks with the sides 20 and 22, respectively, determines that the pocket 18 is 3 inches wide, halves this width to obtain 1½ inches, and marks the midline 32, which is 1½ inches from either side 20 or 22 and is perpendicular to the pocket top 26. To avoid ruining the uniform and to save time, one typically does not use a marking device such as a pencil to mark the midline 32. Instead, one often uses a relatively inaccurate technique such as eyeballing or temporarily marking with a finger.

Next, referring to FIG. 3, one rotates the ruler 30 ninety degrees, aligns the measuring edge of the ruler 30 with the pocket midline 32, aligns a measurement mark with the pocket top 26, measures the specified distance above the top 26, and marks a position 34 for the bottom edge of the award 28. In the illustrated example, one aligns the 8-inch mark with the pocket top 26, measures up ⅛ inch, and marks the position 34.

Still referring to FIGS. 2 and 3, one positions the award 28 (FIG. 1) by horizontally centering the award 28 about the midline 32 and aligning the award's bottom edge with the position 34 such that the bottom edge is parallel to the pocket top 26. Although one can use the ruler 30 to locate the horizontal midline of the award 28 and to insure that the award's bottom edge is parallel to the pocket top 26, he/she typically eyeballs these measurements.

Unfortunately, the ruler 30 and other like measurement devices are often cumbersome, inaccurate, and time consuming when used for two-dimensional positioning of an item on a back piece such as the uniform 12 (FIG. 1). For example, referring to the item-placement procedure discussed above in conjunction with FIGS. 2 and 3, eyeballing or using a finger to temporarily mark the midline 32 while rotating the ruler 30 into the second position (FIG. 3) is difficult even with good coordination and steady hands, and can be next to impossible for someone without these attributes. Furthermore, eyeballing and finger marking often cause noticeable alignment errors. Although one can go back and correct such errors, such re-positioning can add a significant amount of time to the positioning process, particularly when one must position and attach a large number of items.

SUMMARY OF THE INVENTION

In one aspect of the present invention, a device includes first and second scales. The first scale has a reference mark, at least one first mark disposed a first distance from the reference mark in a first direction, and at least one second mark disposed the first distance from the reference mark in a second direction that is opposite to the first direction. The second scale is perpendicular to the first scale and includes at least one third mark disposed a second distance from the first scale.

One can use such a device to position items on a uniform or other back piece without the guesswork associated with conventional measuring devices. For example, he/she can use the first scale as a centering scale to locate a pocket midline, and then, without having to move the device, can use the second scale as a measuring scale to locate a point along the pocket midline. Therefore, using such a device, one can place an item such as a badge above the pocket more easily, accurately, and quickly than if he/she used a conventional measuring device.

DETAILED DESCRIPTION OF THE INVENTION

Figure 1:
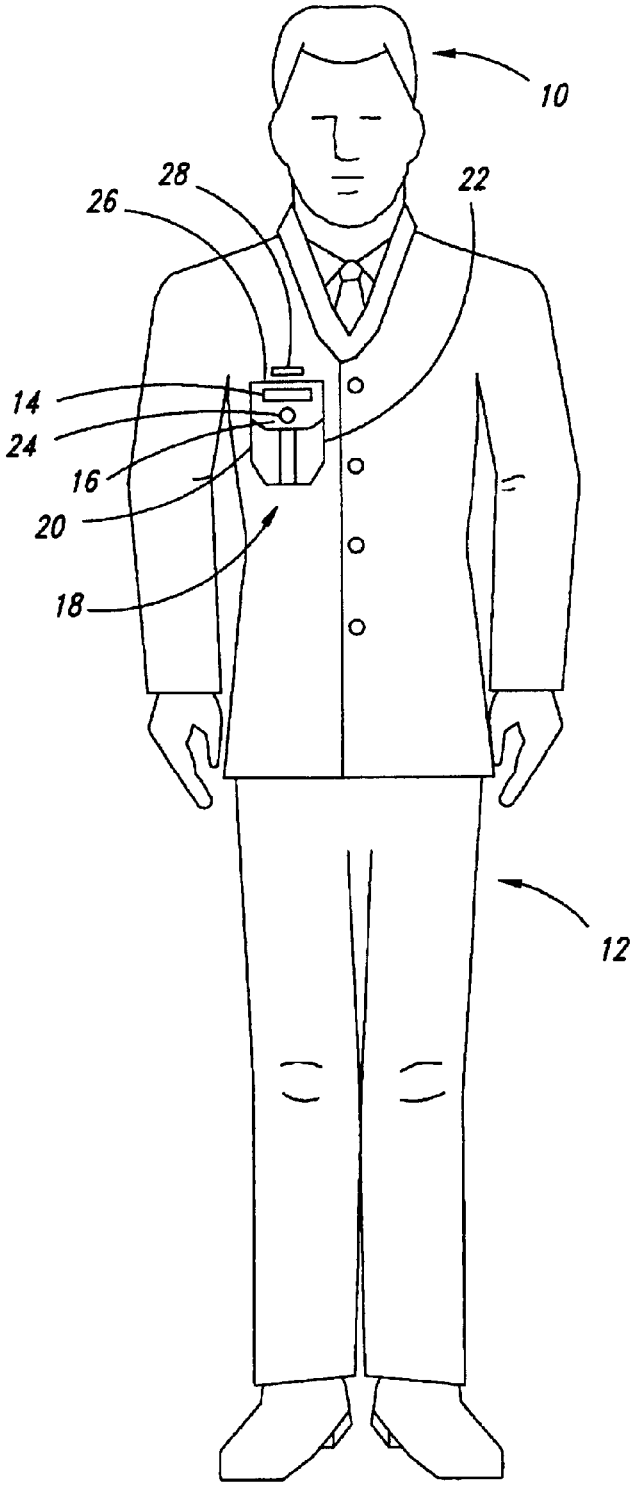
Fig. 1 (Prior Art)
FIG. 1 is a front view of a soldier wearing a military uniform having several items attached thereto.
Figure 2:
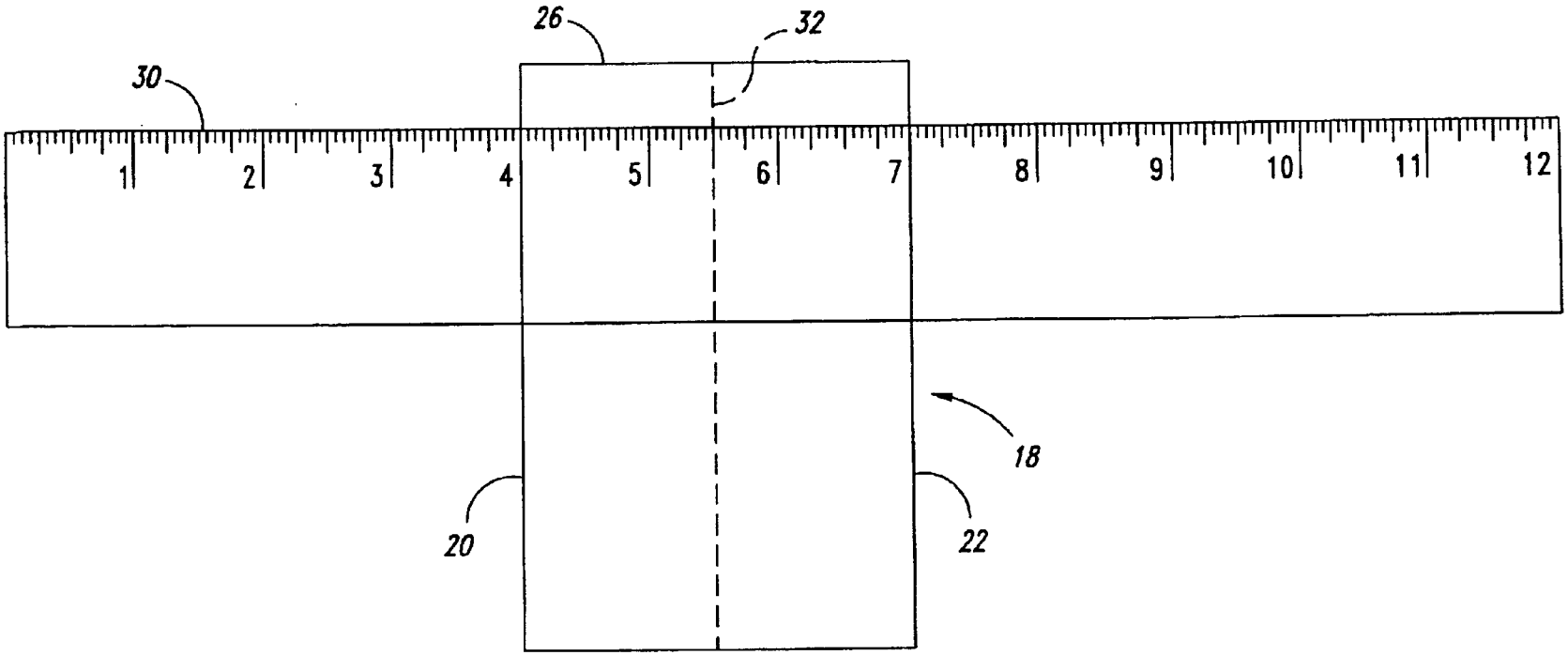
Fig. 2 (Prior Art)
FIG. 2 illustrates a conventional procedure for locating the horizontal midline of a pocket of the uniform of FIG. 1.
Figure 3:
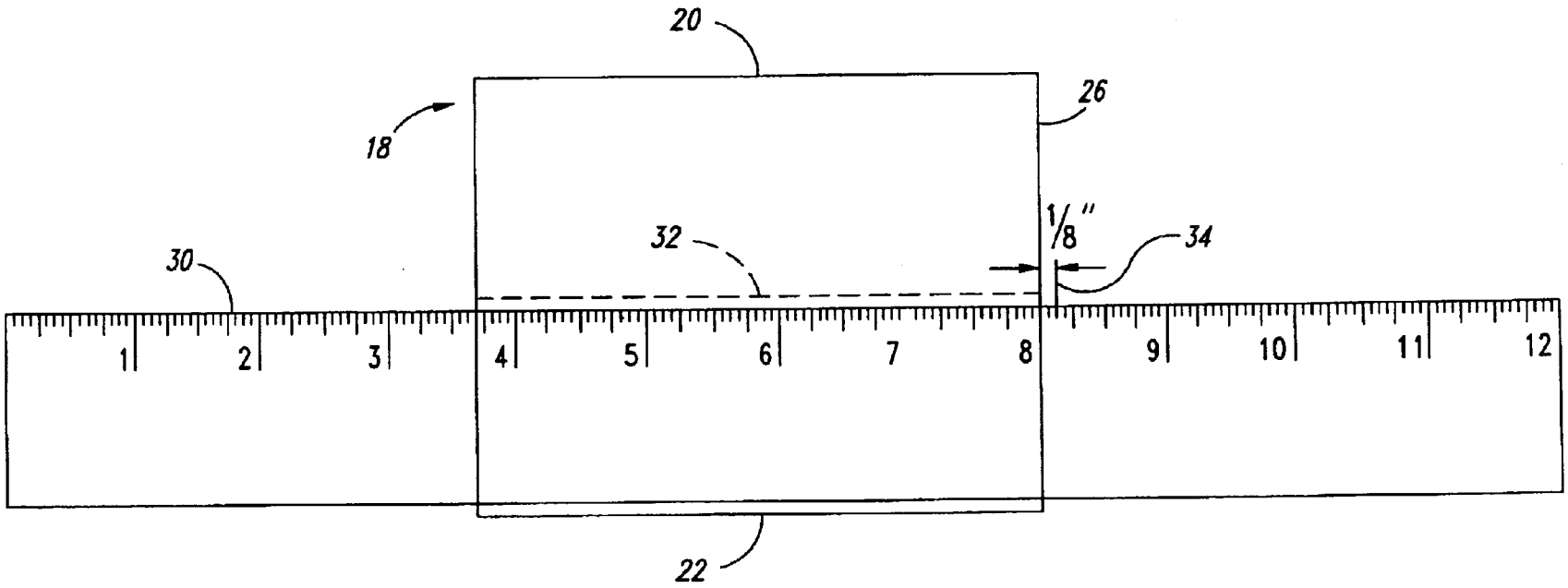
Fig. 3 (Prior Art)
FIG. 3 illustrates a conventional procedure for locating a specified position for an item with respect to the pocket's horizontal midline.
Figure 4:
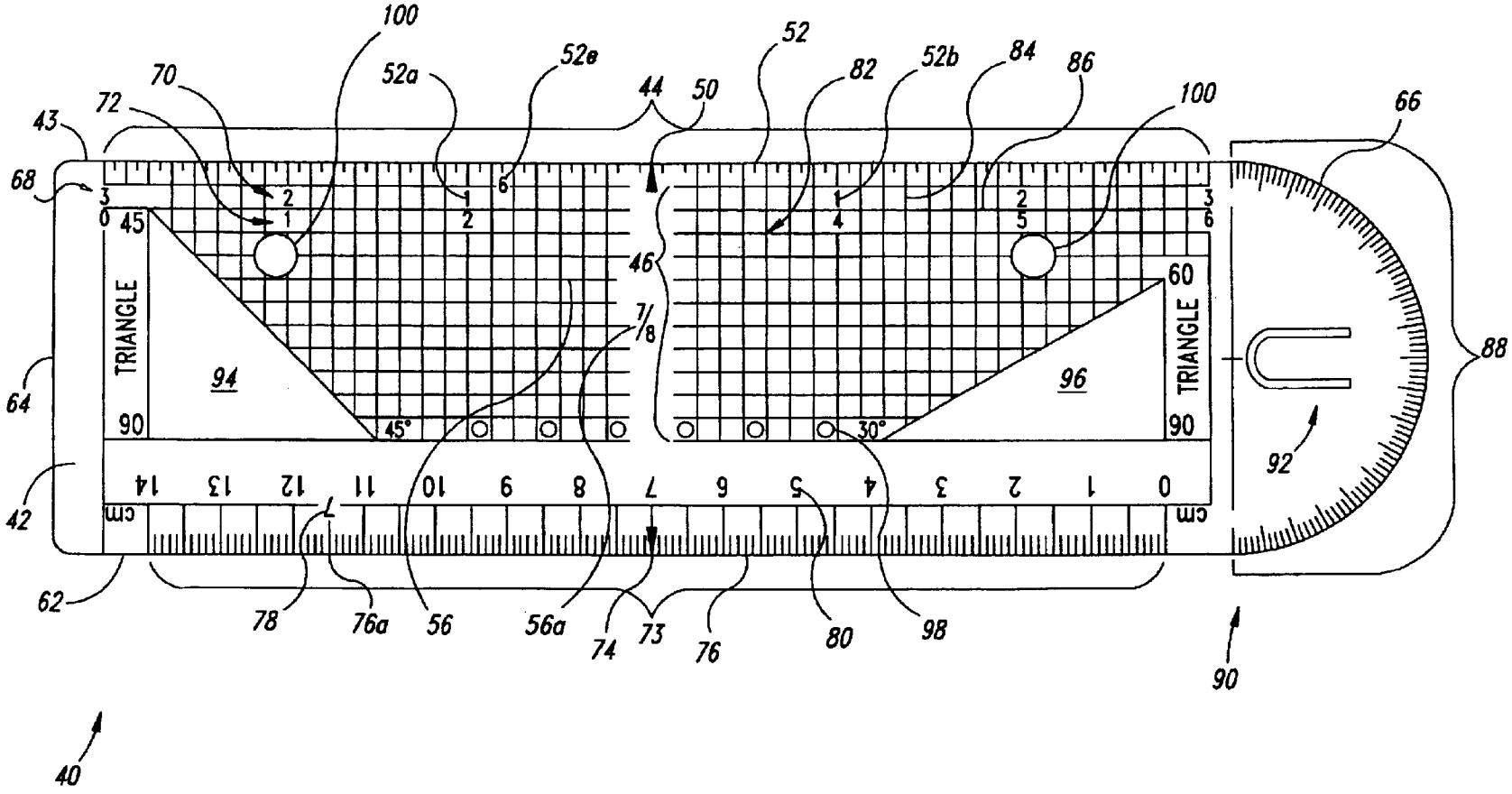
FIG. 4 is a side plan view of a multi-scale device according to an embodiment of the invention.

FIG. 4 is a side plan view of a multi-scale measuring device 40 according to an embodiment of the invention. The device 40 includes a member 42 having an edge 43, at least one centering scale 44 disposed on the member 42 along the edge 43, and at least one measuring scale 46 disposed on the member 42 and perpendicular to the scale 44. In one embodiment, the member 42 is formed from a transparent material such as plastic, although it may be formed from other transparent or opaque materials. The centering scale 44 includes a centering mark 50, which is used to indicate the center of a region in a dimension parallel to the scale 44. Although the centering mark 50 is shown in the absolute center of the scale 44, it can be offset from the absolute center. The scale 44 also includes alignment marks 52, which are labeled according to their respective distances from the centering mark 50. For example, in the illustrated embodiment, alignment marks 52*a* and 52*b* are each labeled with a respective "1" to indicate that they are each 1 inch, and thus equidistant, from the centering mark 50. The measuring scale 46 includes alignment marks 56, which are labeled according to their respective distances from the edge 43. For example, in the illustrated embodiment, the mark 56*a* is labeled with a "⅞" to indicate that it is ⅞ inch from the edge 43.

Figure 5:
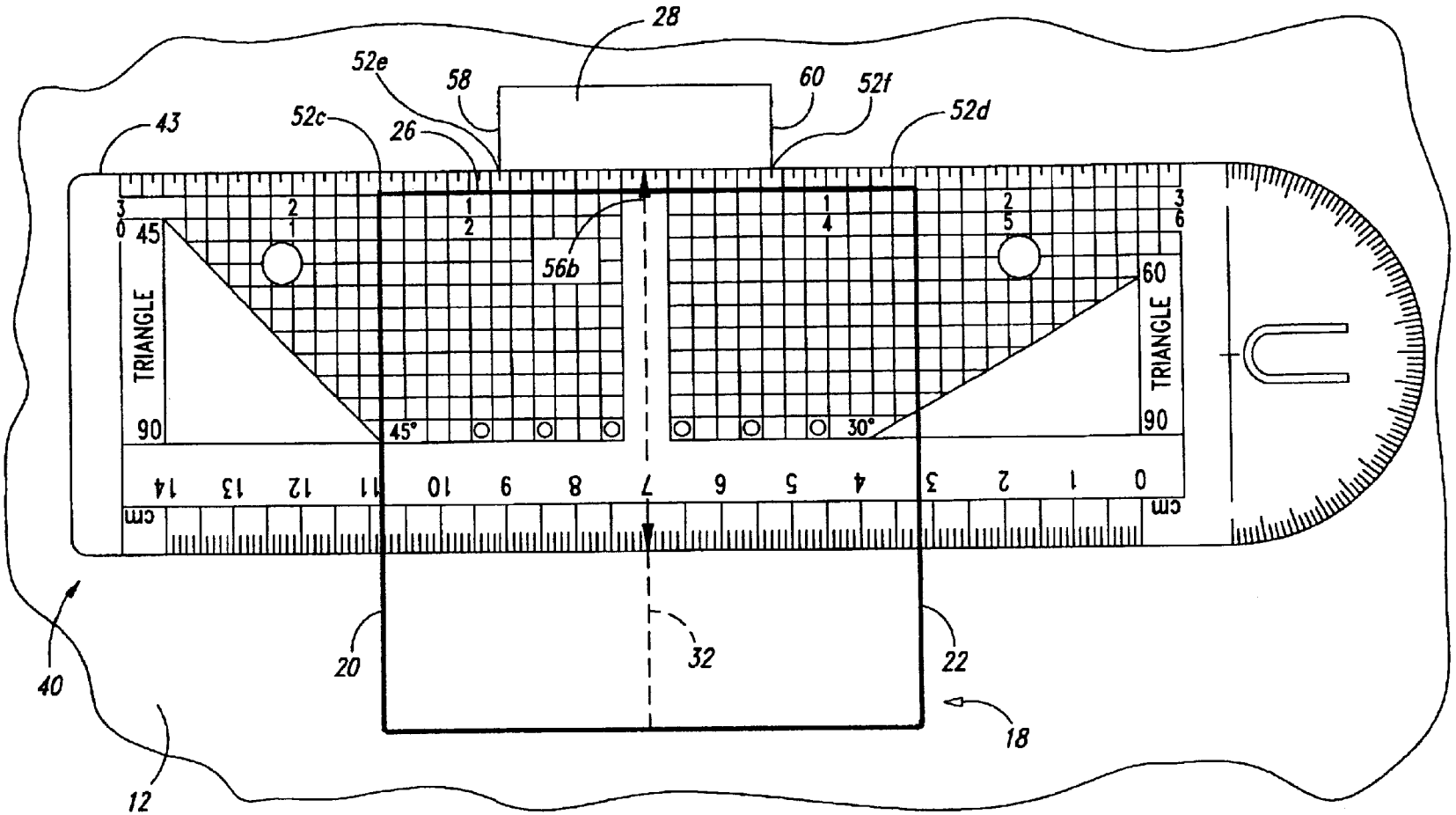
FIG. 5 illustrates a procedure for locating a specified position for an item according in an embodiment of the invention.

FIG. 5 illustrates a procedure for using the device 40 (FIG. 4) to properly position an item such as the award 28 on a back piece such as the uniform 12. For example purposes, FIG. 5 specifically illustrates using the device 40 to center the unit award 28 ⅛ inch above the pocket 18 of the uniform 12.

First, one finds the horizontal midline 32 (i.e., the line which divides the pocket 18 in half horizontally) of the pocket 18 by finding the pair of equidistant alignment marks 52*c* and 52*d* that respectively line up with the pocket sides 20 and 22. If there is no equidistant pair of marks 52 that align with the pocket sides 20 and 22, then one merely interpolates by aligning each of the sides 20 and 22 the same distance from the closest respective mark 52.

Next, one finds the center point of the award 28 bottom by aligning the ⅛" mark 56*b* with the pocket top 26 such that the device edge 43 is ⅛" above and parallel to the top 26. The centering mark 50 now points to the center point of the award 28 bottom.

Then, one places the bottom of the award 28 against the edge 43 and aligns sides 58 and 60 of the award 28 with equidistant alignment marks 52*e* and 52*f*, respectively. This centers the award 28 about the centering mark 50, and thus about the pocket midline 32. Next, one secures the award 28 to the uniform 12 in a conventional manner.

Although FIG. 5 illustrates the positioning of the award 28 on the uniform 12, one can use the device 40 to position other items on other back pieces in a similar manner. Therefore, one can use the device 40 to position an item in two dimensions without calculating positions such as the horizontal mid line and without rotating the device 40 from one dimension to the other during the positioning procedure. Thus, positioning an item with the device 40 is often less cumbersome, less complex, less time consuming, and more accurate than positioning the same item with a conventional measuring device.

Referring again to FIG. 4, the illustrated embodiment of the device 40 is discussed in more detail. Other embodiments, however, lack some or all of the below-described features, and still other embodiments include additional features such as conventional-measuring-device features.

In this embodiment, the member 42 is a rectangular piece of flexible, clear plastic with overall dimensions of approximately 2 inches by 8 inches, and in addition to the straight edge 43, includes a second straight edge 62, which is parallel to the edge 43, a third straight edge 64, and a fourth semi-circular edge 66, which is opposite the edge 64.

The scale 44 is approximately 6" long, and the reference marks 52 are disposed every 1/16 inch from the centering mark 50. A first set of reference numbers 68 labels every other mark 52, and each number indicates the distance of the respective mark from the centering mark 50 in ⅛-inch intervals offset by 1/16 inch. For example, the number "6", which labels the mark 52*e*, indicates a distance of ⅝ inch+1/16 inch=13/16 inch from the centering mark 50. Therefore, starting at the centering mark 50, the numbers 68 increase in both directions along the scale 44. Similarly, a second set of reference numbers 70 labels every eighth mark 52, and each number indicates the distance of the respective mark from the centering mark 50 in 1-inch intervals. A third set of numbers 72 also labels every eighth mark 52, but each number 72 indicates the distance of the respective mark from the end of the scale 44 nearest the edge 64.

Another centering scale 73 runs along the edge 62, is 14 centimeters (cm) long, and includes a centering mark 74 and alignment marks 76, which are disposed on the member 42 every 1 millimeter (mm) from the centering mark 74. A first set of reference numbers 78 labels every fifth mark 76, and each number indicates the distance of the respective mark from the centering mark 74 in 5 mm intervals. For example, the number "7", which labels the mark 76*a*, indicates a distance of 7×5 mm=35 mm=3.5 cm. Therefore, starting at the centering mark 74, the numbers 78 increase in both directions along the scale 73. A second set of numbers 80 labels every tenth mark 76, and each number 80 indicates the distance of the respective mark in centimeters from the end of the scale 73 nearest the semi-circular edge 66.

A grid 82 is disposed in a middle portion of the member 42, and includes vertical grid lines 84 and horizontal grid lines 86. The vertical grid lines 84 are extensions of every other mark 52 of the centering scale 44, and the horizontal grid lines 86 are extensions of the marks 56 in the measuring scale 46.

An angular scale 88 is disposed along the edge 66 to form a protractor 90.

A U-shaped pocketbook clip 92 is disposed within the protractor 90.

Cut outs 94 and 96, which are shaped as isosceles and 30-60-90 triangles, respectively, and cut outs 98, which are shaped as circles, are disposed in the member 42.

Binder holes 100, which allow the device 40 to be stored in a loose-leaf notebook (not shown), are also disposed in the member 42.

From the foregoing it will be appreciated that, although specific embodiments of the invention have been described herein for purposes of illustration, various modifications may be made without deviating from the spirit and scope of the invention.

What is claimed:

1. A device, comprising;

a see-through member having a first side and a flat or approximately flat second side, the member operable to lie on an object with the second side facing the object and the first side facing away from the object;

a first linear scale disposed on the member and having a reference mark, first alignment marks disposed respective distances from the reference mark in a first direction, and second alignment marks disposed at the same respective distances from the reference mark in a second direction that is opposite to the first direction, the first scale being visible from the first side, corresponding first and second alignment marks operable to align with respective ends of a section of the object such that the reference mark identifies a section center line that is substantially perpendicular to the first linear scale; and a second linear scale disposed on the member, perpendicular to the first linear scale, and including respective third marks disposed respective distances from the first scale, the second scale being visible from the first side, one of the third marks operable to align with a reference point on the center line such that the reference mark of the first linear scale identifies a desired point on the center line.

2. The device of claim 1 wherein the second scale is aligned with the reference mark of the first scale.

3. The device of claim 1 wherein:

the first scale includes a midpoint; and the reference mark is disposed at the midpoint.

4. The device of claim 1 wherein:

the at least one first mark is labeled with a reference character; and the at least one second mark is labeled with the same reference character.

5. The device of claim 1 wherein:

the object comprises an article of clothing;

the section of the object comprises a pocket;

the ends of the section comprise first and second opposite sides of the pocket; and the reference point is located on a third side of the pocket that is adjacent to at least one of the first and second sides.

6. A device, comprising:

a transparent member having an edge, a back surface that is substantially flat, and a side that is opposite the substantially flat surface, the back surface operable to lie on an object;

a centering scale disposed along the edge of the member and viewable from the side of the member, the centering scale having a center point, a centering mark disposed on the center point, first alignment marks disposed at respective distances from the centering mark in a first direction, and second alignment marks disposed at the same respective distances from the centering mark in a second direction that is opposite to the first direction, corresponding first and second alignment marks operable to align with respective ends of a section of the object such that the centering mark identifies a section center line that is substantially perpendicular to the edge of the member; and a measuring scale disposed on the member and aligned with the centering mark in a direction perpendicular to the edge of the member, the measuring scale viewable from the side of the member and including measurement marks disposed respective distances from the edge of the member, one of the measurement marks operable to align with a reference point on the center line such that a portion of the member edge aligned with the centering mark of the centering scale identifies a predetermined point on the center line.

7. The device of claim 6 wherein the measuring scale includes labels that are each adjacent to a respective measurement mark and that each indicate the distance between the edge of the member and the respective measurement mark.

8. The device of claim 6 wherein the centering scale includes labels that are each adjacent to a respective one of the first and second alignment marks and that each indicate the distance between the centering mark and the respective alignment mark.

9. The device of claim 6 wherein the measuring scale includes labels that are each adjacent to a respective measurement mark and that each indicate the distance between the edge of the member and the respective measurement mark in English units.

10. The device of claim 6 wherein the centering scale includes labels that are each adjacent to a respective one of the first and second alignment marks and that each indicate the distance between the centering mark and the respective alignment mark in English units.

11. The device of claim 6 wherein the centering scale includes labels that are each adjacent to a respective one of the first and second alignment marks and that each indicate the distance between the centering mark and the respective alignment mark in Metric units.

12. The device of claim 6 wherein the centering scale is longer than the measuring scale.

13. The device of claim 6 wherein the edge of the member is straight.

14. The device of claim 6 wherein the member comprises a plastic.

15. The device of claim 6, further comprising a triangular opening disposed in the member.

16. The device of claim 6, further comprising:

the member having a semicircular edge; and an angle scale disposed on the member along the semicircular edge.

17. The device of claim 6, further comprising:

the member having an end; and a protractor scale disposed on the end of the member.

18. The device of claim 6, further comprising binder openings disposed in the member.

19. The device of claim 6, further comprising a pocket clip attached to the member.

20. A method, comprising:

locating a midline of a region of a first object, the region having an edge and two ends, by, lying a substantially flat see-through member against the region, a centering scale being disposed on the member and being viewable from a side of the member opposite to a side that faces the region, placing an edge of the centering scale along the edge of the region, respectively aligning like centering-scale marks with the two ends of the region, and identifying the midline of the region as being coincidental with a centering mark of the centering scale and perpendicular to the edge of the region; and locating a point outside of the region and aligned with the midline by aligning a measurement mark of a measuring scale with the edge of the region such that the centering mark of the centering scale identifies the point, the measuring scale being disposed on the member, perpendicular to the centering scale, aligned with the centering mark, and viewable from the side of the member opposite to the side that faces the region.

21. The method of claim 20 wherein the measuring scale includes a label that indicates the distance between the measurement mark and the edge of the centering scale.

22. The method of claim 20, further comprising centering second object about the point by:

maintaining alignment of the measurement mark with the edge of the region after locating the point; and respectively aligning two ends of the second object with like centering-scale marks.

23. The method of claim 20 wherein:

the first object comprises an article of clothing; and the region of the first object comprises a pocket.

* * * * *